United States Patent [19]

Tsuneo

[11] Patent Number: 4,640,741

[45] Date of Patent: Feb. 3, 1987

[54] FORMING FABRIC FOR USE IN A PAPERMAKING MACHINE

[75] Inventor: Ishino Tsuneo, Inagi, Japan

[73] Assignee: Nippon Filcon Co., Ltd., Tokyo, Japan

[21] Appl. No.: 653,435

[22] Filed: Sep. 21, 1984

[30] Foreign Application Priority Data

Nov. 30, 1983 [JP] Japan ..... 58-224412

[51] Int. Cl.[4] ..... D03D 13/00; D21F 1/00; D21F 11/00

[52] U.S. Cl. ..... 162/202; 139/383 A; 162/348; 162/DIG. 1; 428/225; 428/255; 428/258

[58] Field of Search ..... 139/383 A; 162/DIG. 1, 162/202, 348; 428/255, 225, 258

[56] References Cited

U.S. PATENT DOCUMENTS

| | | | |
|---|---|---|---|
| 4,071,050 | 1/1978 | Codorniu . | |
| 4,308,897 | 1/1982 | Westhead | 139/383 A |
| 4,327,779 | 5/1982 | Westhead | 139/383 A |
| 4,356,225 | 10/1982 | Dufour | 428/257 |
| 4,361,618 | 11/1982 | Dufour et al. | 428/257 |
| 4,461,803 | 7/1984 | Booth et al. | 139/383 A |

FOREIGN PATENT DOCUMENTS

| | | |
|---|---|---|
| 15842 | 7/1965 | Japan . |
| 88307 | 7/1975 | Japan . |
| 12892 | 1/1980 | Japan . |

*Primary Examiner*—James C. Cannon

*Attorney, Agent, or Firm*—Brumbaugh, Graves, Donohue & Raymond

[57] ABSTRACT

A forming fabric for use in a papermaking machine has two warp layers and three weft layers. The three weft layers are arranged as an uppermost weft layer adapted to define a paper-web supporting surface of the fabric during use, an intermediate weft layer arranged below the uppermost weft layer, and a lowermost weft layer arranged below the intermediate weft layer to define the under-side (i.e. wear-side) of the fabric during use. The two warp layers are arranged as an upper warp layer, the warp threads of which are interwoven only with the uppermost weft layer and with the intermediate weft layer, and a lower warp layer, the warp threads of which are interwoven only with the intermediate weft layer and with the lowermost weft layer. The warp threads of the upper warp layer are exposed on the paper-web supporting surface but are not exposed on the wear-side of the fabric. The warp threads of the lower warp layer are exposed on the wear-side of the fabric but are not exposed on the paper-web supporting surface of the fabric.

17 Claims, 10 Drawing Figures

FORMING FABRIC FOR USE IN A PAPERMAKING MACHINE

BACKGROUND OF THE INVENTION

The present invention relates to a forming fabric for use in a papermaking machine having two warp layers and three weft layers, and more particularly to a forming fabric in which a warp layer and a weft layer defining together a paper-web supporting surface of the fabric are constructed separately from or independently of a warp layer and a weft layer defining together a wear-side (i.e. under-side) surface of the fabric.

Conventional well-known double-layer fabrics now in use in paper-making machines have two layers of synthetic weft threads disposed one above the other and a layer of synthetic warp threads interconnecting said weft threads. One of such prior art fabrics is disclosed in U.S. Pat. No. 4,071,050. In such construction of the fabrics, the warp threads are interwoven with the weft threads of an upper weft layer to form a paperweb supporting surface of the fabric, and the same warp threads are also interwoven with the weft threads of a lower weft layer to form a wear-side (i.e. underside) of the fabric. Accordingly, in order to improve the quality of paper sheets formed on the fabric, particularly to improve the "wire-mark characteristics" of the fabric, it is necessary to make the warp thread diameter smaller or finer, and on the other hand, in order to improve the wear-resistance or abrasion-resistance of the fabric, it is necessary to make the diameter larger or thicker.

This is also true even when the under-side knuckles of the weft threads of the lower weft layer are positioned outside the under-side knuckles of the warp threads so that the weft threads knuckles are subject to wear prior to the warp threads knuckles, as is the case in what are generally referred as "weft runner type" fabrics. In other words, in "weft runner type" fabrics, the lower weft threads begin to wear prior to warp threads. However, after the weft threads have been worn to a certain degree, the warp threads will also begin to wear and eventually will be worn through and then broken by the tension exerted on the fabric by the driving rolls of the paper-making machine. This leads to an extremely dangerous operation of the fabric during use, causing the fabric to be suddenly broken throughout the entire width thereof. Thus, conventional double-layer fabrics for use in paper-making machines have two incompatible requirements. Namely, when smaller diameter warp threads are employed to improve the paper-quality or particularly the "wire-mark characteristics" of the fabric, the wear resistance of the fabric is reduced and, inversely when larger diameter warp threads are employed to increase the wear resistance of the fabric, the "wire-mark characteristics" of the fabric will be deteriorated, leading to an unacceptable paper quality.

Heretofore, there have been various proposals in order to remove the above-described problem. For example, there are prior-art publications such as Japanese Public Disclosure No. 55-12892, Japanese Public Disclosure No. 50-88307, and Japanese Patent Publication No. 40-15842. Such prior techniques, however, do not sufficiently overcome the above-described problem, and most importantly, they have serious disadvantages as will be explained below in detail.

First, Japanese Public Disclosure No. 55-12892 discloses a forming fabric for use in papermaking machines which comprises a first set of warp threads and a first set of weft threads which are interwoven to form a first complete weave to define a paper-web supporting surface, and a second set of warp threads and a second set of weft threads which are interwoven to form a second complete weave to define the wear-side of the fabric, characterized in that separate binder weft threads are used to interconnect the first weave and the second weave, which binder weft threads are positioned between the two weaves and interwoven with threads from the first and the second sets of warp threads. In such construction of the fabric, since warp threads are interconnected with associated binder weft threads at a predetermined interval or pitch, the paper web supporting surface of the first complete weave tends to have an uneven pattern above or over interconnection points of threads from the first sets of warp threads with associated binder wefts. In other words, since the binder weft threads extend substantially straight between the two weaves, at interconnection points of warp threads from the first complete weave with the binder weft threads, the amount of crimp (formed during weaving) of the warp threads and that of remainder warp threads not interconnected with the binder weft threads are different, resulting in irregular patterns at the points (i.e. unevenness) different from the normal weave patterns of the first complete weave, causing "wire-mark" on the paper sheets formed on the fabric. Further, as stated above, in this fabric, the first complete weave and the second complete weave are interconnected by means of the binder weft threads and particular warp threads selected from the first and the second sets of warp threads of the two complete weaves, the selected warp threads being interconnected with the binder weft threads. Therefore, as the fabric travels around a plurality of rolls of a papermaking machine, the first complete weave is gradually displaced forwardly relative to the second complete weave, as a result of which the selected warp threads and/or the binder weft threads will be broken or cut at their interconnecting points.

Second, Japanese Public Disclosure No. 50-88307 discloses a forming fabric for use in a papermaking machine which comprises a first set of warp threads and a first set of weft threads which are interwoven to form a first complete weave, and a second set of warp threads and a second set of weft threads which are interwoven to form a second complete weave, threads from the first set of weft threads and threads from the second set of weft threads being interconnected by means of binder warp threads. For the same reason described above in connection with Japanese Public Disclosure No. 55-12892, the binder warp threads will be eventually broken, resulting in a shorter effective life of the fabric.

Third, Japanese Patent Publication No. 40-15842 discloses a fabric for use in a papermaking machine which comprises a first set of warp threads and a first set of weft threads which are interwoven to form a first complete weave, and a second set of warp threads and a second set of weft threads which are interwoven to form a second complete weave, a part of the first set of warp threads (i.e. binder warp threads) being interconnected with selected threads from the second set of weft threads. In this fabric, since the binder warp threads are interconnected with selected threads from the second set of weft threads at a predetermined interval or pitch, at these interconnection points the paper-web supporting surface of the first complete weave becomes uneven, causing "wire-mark" on paper sheets conveyed by the fabric. Furthermore, for the reason described above, the first complete weave is gradually displaced forwardly relative to the second complete weave, as a result of which, the binder warp threads will eventually be broken or cut at their interconnection points.

The present inventor has found that the above described disadvantages result from the fact that two or three complete weaves are interconnected by means of binder threads. The inventor has also found that the disadvantages described above cannot be removed through such prior art fabrics, and has invented novel forming fabrics consisting of only a single complete weave having two warp layers and three weft layers, which fabrics are capable of removing such disadvantages.

SUMMARY OF THE INVENTION

The present invention concerns, in the first aspect, a forming fabric for use in a papermaking machine having two warp layers and three weft layers, which comprises an upper-most weft layer adapted to define a paper-web supporting surface of said fabric during in use, an intermediate weft layer arranged below said uppermost weft layer, a lowermost weft layer arranged below said intermediate weft layer to define the underside of said fabric during use, an upper warp layer the warp threads of which are interwoven only with said upper-most weft layer and with said intermediate weft layer, and a lower warp layer the warp threads of which are interwoven only with said intermediate weft layer and with said lower-most weft layer.

The present invention, in the second aspect, concerns a forming fabric for use in a papermaking machine having two warp layers and three weft layers, which comprises an uppermost weft layer adapted to define a paper-web supporting surface of said fabric during use, an intermediate weft layer arranged below said uppermost weft layer, a lowermost weft layer arranged below said intermediate weft layer to define the under-side of said fabric during use and having a coarser weft density (the term "weft density" means weft numbers per unit length of the fabric) than that of said intermediate weft layer, an upper warp layer the warp threads of which are interwoven only with said uppermost weft layer and with said intermediate weft layer, and a lower warp layer the warp threads of which are interwoven only with said intermediate weft layer and with said lowermost weft layer.

Since the forming fabric according to the present invention is constituted as described above, in order to improve the wear-resistance or abrasion-resistance of the fabric, the warp threads of the lower warp layer may be made from wear-resistant materials. In other words, the warp threads of the lower warp layer are never exposed on the paper-web supporting surface and therefore do not have a direct effect on the "wire-marks" formed on the paper sheets, the hydrophilic property of the fabric surface or other aspects of papermaking performance, and therefore may be selected from only a viewpoint of the wear-resistance of the fabric. For example, the warp threads of the lower warp layer may have a greater diameter than that of those of the upper warp layer, and may be made from a wear-resistant material such as polyamide. Since the warp threads of the upper warp layer are interwoven only with the upper-most weft layer and with the intermediate weft layer, and are not exposed on the wearside or under-side of the fabric, the upper warp threads have no effect on the wear-resistance of the fabric, and thus may be selected from only a viewpoint "wire-mark" characteristics and other aspects of papermaking performance.

Furthermore, since the fabric according to the present invention having two warp layers and three weft layers forms "only a single" complete weave, when traveling on a papermaking machine, the fabric will not be broken due to the relative displacement of two complete weaves as has been inevitable in prior art fabrics as explained above.

In the second aspect of the present invention, the lower-most weft layer has a coarser weft density than that of the intermediate weft layer, and therefore will exhibit greater water-permeability than in the first aspect of the present invention. In addition, the second aspect of the present invention, of course, includes the fabric in which the weft density of the intermediate weft layer is smaller than that of the uppermost weft layer and the weft density of the lowermost weft layer is smaller than that of the intermediate weft layer.

BRIEF DESCRIPTION OF THE DRAWINGS

The present invention will be described more in detail in the following description with reference to the accompanying drawings, in which.

PREFERRED EMBODIMENTS FOR CARRYING OUT THE INVENTION

Figure 1:
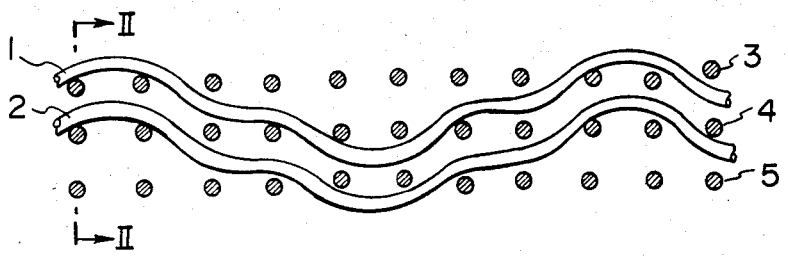
FIG. 1 is a partial longitudinal section of one preferred embodiment of a forming fabric according to the present invention.

Referring to the drawings, as shown in FIG. 1, the forming fabric according to the present invention comprises an uppermost weft layer 3 each weft thread of which extends in the cross-machine direction and defines a paper-web supporting surface during use, an intermediate weft layer 4 which is arranged beneath the uppermost weft layer 3, and a lowermost weft layer 5 which is arranged beneath the intermediate weft layer 4 and defines an under-surface of the fabric i.e. a surface exposed to wear elements (not shown) such as suction boxes during use. As shown in FIG. 1, each of the weft threads of the uppermost weft layer 3, the intermediate weft layer 4 and the lowermost weft layer 5 is vertically aligned with each other and extends in the cross-machine direction when the fabric is moved on a papermaking machine. The forming fabric further comprises an upper warp layer 1 the warp threads of which are interwoven only with the uppermost weft layer 3 and with the intermediate weft layer 4 so that the warp threads of the warp layer 1 cannot be positioned lower than the lowermost weft layer 5 to be exposed to the wear elements, and a lower warp layer 2 the warp threads of which are interwoven only with the intermediate weft layer 4 and with the lowermost weft layer 5 so that the warp threads of the warp layer 2 cannot be positioned higher than the uppermost weft layer 3 adapted to support a paper web thereon during in use. In other words, as shown in FIG. 1, the warp threads of the upper warp layer 1 pass over the upper most weft layer 3, and between the uppermost weft layer 3 and the intermediate weft layer 4, and between the intermediate weft layer 4 and the lowermost weft layer 5, and then again between the uppermost weft layer 3 and the intermediate weft layer 4, and then again appear over the uppermost weft layer 3 to complete one cycle of a weave pattern. Thus, the upper warp layer 1 defines the paper-web supporting surface during use together with the uppermost weft layer 3 but is not subject to wear or abrasion by wear elements. Further, as shown in FIG. 1, the warp threads of warp layer 2 of the lower warp layer 2 pass between the uppermost weft layer 3 and the intermediate weft layer 4, and then between the intermediate weft layer 4 and the lowermost weft layer 5, and then beneath the lowermost weft layer 5, and then again between the intermediate weft layer 4 and the lowermost weft layer 5, and then again appear between the uppermost weft layer 3 and the intermediate weft layer 4 to complete one cycle of a weave pattern. Thus, the lower warp layer 2 will appear on the wear-side of the fabrics but not be exposed on the paper-web supporting surface, so that they have no direct effect on the 'wire-mark chracteristics' of the fabric.

Figure 2:
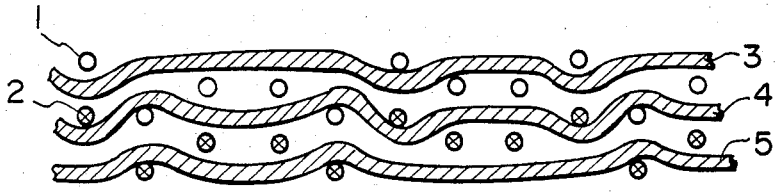
FIG. 2 is a cross section taken along line II—II of FIG. 1.

Referring now to FIG. 2, the warp threads of the upper warp layer 1 are depicted by circles " ", and the warp threads of the lower warp layer 2 are depicted by circles with a cross mark " x ". Both the warp layers 1 and 2 have the same density i.e. the same number of warp threads per unit width of the fabric each of the warp threads of layers 1 being vertically aligned with one of the warp threads of layer 2.

Figure 3:
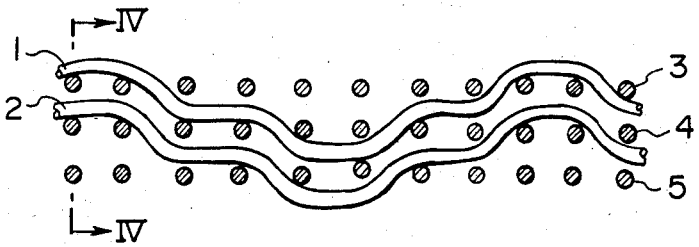
FIG. 3 is a partial longitudinal section of another embodiment of the forming fabric according to the present invention.
Figure 4:
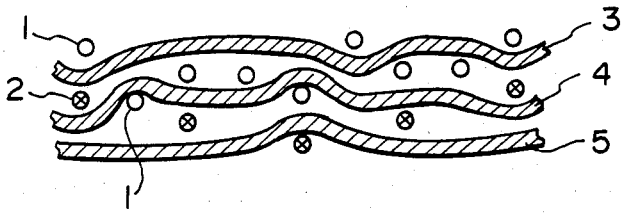
FIG. 4 is a cross section taken along line IV—IV of FIG. 3.

Referring now to FIG. 4, which shows a cross section taken along line IV—IV of FIG. 3, the warp density (the term "warp density" means warp numbers per unit width) of the lower warp layer 2 is coarser than that of the upper warp layer 1, and in a particular embodiment shown in FIG. 4, the former is one half of the latter. As the warp density of the lower warp layer 2 becomes smaller, the void % per unit volume of the fabric increases to thereby increase the water-permeability thereof. The ratio of the warp density of the upper warp layer 1 relative to that of the lower warp layer 2 may be, for example, 2 to 1, 3 to 2, 4 to 3, 3 to 1, and 4 to 1 etc. and as this ratio becomes larger, the water-permeability will increase while the stiffness of the fabric will decrease. In addition, if ratio such as 3 to 2, 4 to 3, 3 to 1, and 4 to 1 other than 2 to 1 should be employed, when the fabric is traveling on a paper-making machine, a regular striped pattern or unevenness tends to be formed on the paper-supporting surface of the fabric, affecting the water-permeability of the fabric, resulting in "wire-mark" on the paper sheet formed on the fabric. Accordingly, when the warp density of the lower warp layer 2 is selected to be smaller than that of the upper warp layer 1, preferably the former is one half of the latter, and most preferably, as shown in FIG. 4, the warp threads " x " of the lower warp layer 2 should be arranged beneath alternate ones of the warp threads " " of the upper warp layer 1.

Referring now to FIG. 3, the under-side knuckles of the warp threads of the lower warp layer 2 protrude lower than the lowermost weft layer 5, although longitudinal tension exerted on the fabric after weaving operation may cause the under-side knuckles to be positioned on the same level as or a higher level than under-side knuckles of adjacent threads of the lowermost weft layer 5. In this case, the lower most weft layer 5 will be subject to wear befor the lower warp layer 2 begins to wear. This type of fabric is generally called the "weft-runner type". Even if the weft-runner type fabric is employed, after the lowermost weft layer 5 has begun to wear or has been worn away, the lower warp layer 2 will be exposed to wear elements. Thus, the coarser warp density of the lower warp layer 2 for increasing water-permeability of the fabric will result in smaller wear-resistance of the fabric. Therefore, in order to compensate for such reduction of the wear-resistance of the fabric, it is prefered that the diameter of the warp threads of the lower warp layer 2 are greater than that of the upper warp layer 1. Most preferably, the former should be within the range of 1.3–2 times that of the latter.

If this ratio is smaller than 1.3, the improvement of the wear-resistance of the fabric is insufficient and on the other hand, if this ratio is greater than 2.0, the water-permeability of the fabric is significantly reduced and the fabric tends to wrinkle or crease during use.

Figure 5:
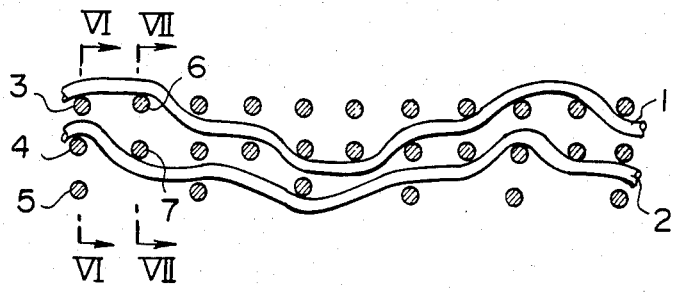
FIG. 5 is a partial longitudinal section of a further embodiment of the forming fabric according to the present invention.
Figure 6:
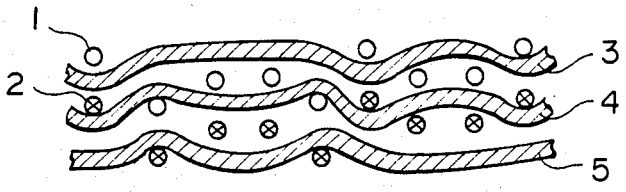
FIGS. 6 and 7 are cross sections taken along lines VI—VI and VII—VII of FIG. 5, respectively.
Figure 7:
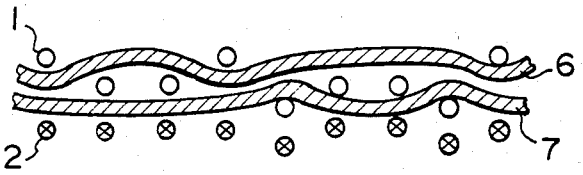

Referring now to FIG. 5, showing a partial longitudinal section of a further embodiment of the forming fabric according to the present invention, the weft density of the lowermost weft layer 5 is smaller than those of the uppermost weft layer 3 and the intermediate weft layer 4 respectively, and in the particular example as shown in FIG. 5, the former is one half of the latter. In such a manner, the void % per unit volume of the fabric is increased so that the water-permeability will be increased. The ratio of the weft-density of the intermediate weft layer 4 relative to that of the lowermost weft layer 5 may be 2 to 1, 3 to 2, 4 to 3, 3 to 1, 4 to 1 etc.. The larger this ratio is, the greater the water-permeability will be, but on the other hand, a larger ratio results in a lower stiffness of the fabric. In addition, if an ratio such as 3 to 2, 4 to 3, 3 to 1, or 4 to 1 other than 2 to 1 should be employed, when the fabric is traveling on the paper-making machine, a regular striped pattern or unevenness tends to be formed on the paperweb supporting surface of the fabric, affecting the water-permeability of the fabric and resulting in "wire-mark" on the paper-sheet formed on the fabric. Accordingly, when the weft density of the lowermost weft layer 5 is selected to be smaller than that of the intermediate weft layer 4 (and hence also the uppermost weft layer 3), preferably the former is one half of the latter, and most preferably, as shown in FIG. 5, the weft threads of the lowermost weft layer 5 should be disposed beneath alternate ones of the intermediate weft layer 4.

In FIG. 5, the warp threads of the upper warp layer 1 pass over two consecutive weft threads of the uppermost weft layer 3,6, and then between the uppermost weft layer 3,6 and the intermediate weft layer 4,7, and then between the intermediate weft layer 4.7 and the lowermost weft layer 5, and then again between the uppermost weft layer 3,6 and the intermediate weft layer 4,7, and then again appears above the uppermost weft layer 3,6 to complete one cycle of the weave pattern. Consequently, the upper warp layer 1 appears over the paper-web supporting surface of the fabric, but is not exposed to wear elements of the paper-making machine.

In FIG. 5, the warp thread of the upperwarp layer 2 passes between the uppermost weft layer 3 and the intermediate weft layer 4, and then between the intermediate weft layer 7,4,7 and the lowermost weft layer 5, and then appears beneath the lowermost weft layer 5, and again between the intermediate weft layer 7,4,7 and the lowermost weft layer 5, and again appears between the uppermost weft layer 3 and the intermediate weft layer 4 to complete one cycle of the weave pattern. Accordingly, the warp threads of the lower warp layer 2 are exposed to the wear elements of the paper-making machine, but do not appear over the paper web supporting surface of the fabric.

Referring again to FIG. 5, when longitudinal tension is applied to the fabric, the tension will be imparted to the lower warp layer 2, and as a result, the underside (i.e. wear-side) knuckles of the warp thread of the lower warp layer 2 will exert an upward vertical component of the tension on the lowermost weft layer 5 interwoven therewith to push upwardly the knuckles of the weft threads of the layer 5, whereby the underside knuckles of the warp thread of the layer 2 may be positioned within the fabric so as not to be exposed to wear elements of a paper-making machine. In this manner, the fabric may be made up in a so-called "weft-runner type".

On the other hand, the coarser weft density of the lowermost weft layer 5 for increasing water permeability of the fabric will result in smaller wear-resistance of the fabric. Therefore, in order to compensate for the reduction of the wear-resistance of the fabric, it is prefered that the diameter of the weft threads of the lowermost weft layer 5 are greater than those of the intermediate weft layer 4 and of the uppermost weft layer 3. The former, most preferably, should be within the range of 1.3–2 times of the latter.

If this ratio is smaller than 1.3 times, the improvement of the wear-resistance of the fabric is insufficient, and on the other hand, if this ratio is greater than 2.0, the water-permeability of the fabric is significantly reduced and the fabric tends to wrinkle or crease during operation.

Figure 8:
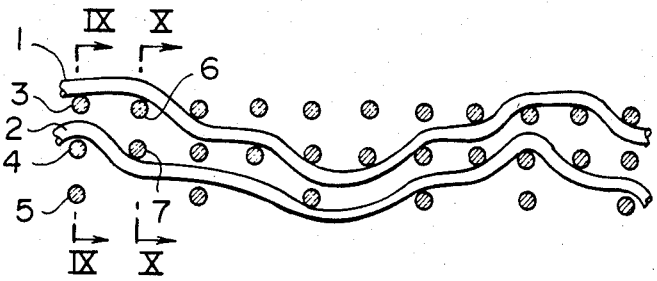
FIG. 8 is a partial longitudinal section of a still further embodiment of the forming fabric according to the present invention.
Figure 9:
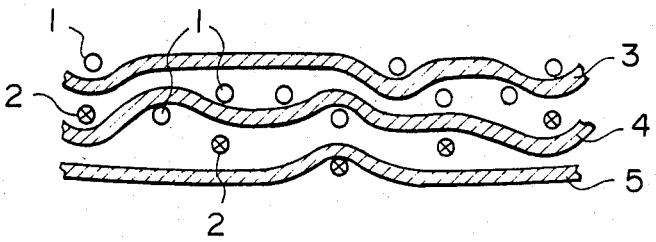
FIGS. 9 and 10 are cross sections taken along lines IX—IX and X—X of FIG. 8, respectively.
Figure 10:
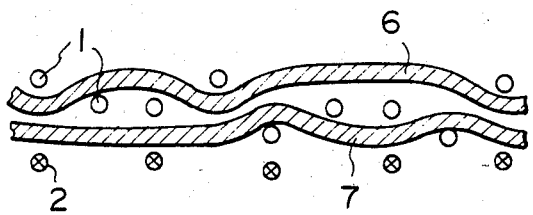

Referring now to FIGS. 8 to 10, the weft density of the lowermost weft layer 5 is smaller than those of the uppermost weft layer 3 and of the intermediate weft layer 4, and the warp density of the threads " x " lower warp layer 2 is smaller than that of the upper warp layer 1.

In FIG. 8, the weft threads of the lowermost weft layer 5 are disposed beneath alternate ones of the intermediate weft layer 4.

In FIG. 9 showing a cross section taken along line IX—IX of FIG. 8, the warp threads (depicted by " x ") of the lower warp layer 2 are arranged beneath alternate ones of the upper warp layer 1.

FIG. 10 shows a cross section taken along line X—X of FIG. 8. This structure of the fabric shown in FIGS. 8 to 10 permits the water-permeability of the fabric to be significantly increased.

From the forgoing, it is seen that the forming fabric of the present invention has the above-described features, has no disadvantages of the prior art fabrics, and can exhibit greater wear-resistance than conventional double-layer fabrics. In addition, even after the threads of the lower warp layer 2 have been worn away at their under-side knuckles and broken, the upper warp layer 1 will completely remain without any wear, and therefore the entire fabric may be maintained without breakage and without any disadvantageous effect on the paper sheet formed on the fabric, thus resulting in a longer effective life for the fabric.

Filaments constituting the fabrics in accordance with the present invention may be made from any suitable materials or synthetic regins, preferably from polyester or polyamide monofilaments. Furthermore, the lower warp layer 2, entirely or in part, may be made from wear-resistant synthetic resins, for example, from a polyamide such as 610-Nylon, 66-Nylon, 6-Nylon, 612-Nylon etc., or be made of composite mono-filaments consisting of an outer shell made from polyamide and an interior core made from polyester, and the remaining lower warp layer 2 and the upper warp layer 1 may be made of polyester mono-filaments having a lower elongation than that of polyamide mono-filaments. In addition, the lowermost weft layer 5 may be made of wear-resistant polyamide monofilaments, and the uppermost weft layer 3 and the intermediate weft layer 4 may respectively be made of polyester mono-filaments having greater stiffness than that of polyamide mono-filaments. In this manner, the fabric may be constructed so as to exhibit its greater wear-resistance both in construction and in the materials constituting it. Further, compared with conventional double-layer fabrics, the forming fabric according to the present invention can have greater stiffness in the cross-machine direction, greater resistance against wrinkles and creases, greater dimensional stability and greater positional stability on the paper-making machine.

While the present invention has been particularly shown and described with reference to preferred embodiments thereof, it will be understood by those skilled in the art that the forgoing and other changes in form and details can be made therein without departing from the spirit and scope of the invention.

What is claimed is:

1. A forming fabric for use in a papermaking machine having two warp layers consisting of machine direction threads and three weft layers consisting of cross machine direction threads, comprising:

an uppermost weft layer adapted to define the Paper-web supporting surface of said fabric during use;

an intermediate weft layer arranged below said uppermost weft layer;

a lowermost weft layer arranged below said intermediate weft layer to define the under-side of said fabric during use;

an upper warp layer, the warp threads of which are interwoven only with said uppermost weft layer and with said intermediate weft layer; and a lower warp layer, the warp threads of which are interwoven only with said intermediate weft layer and said lowermost weft layer, the warp threads of the lower warp layer passing between the uppermost weft layer and the intermediate weft layer, and then between the intermediate weft layer and the lowermost weft layer, and then beneath the lowermost weft layer, and then again between the intermediate weft layer and the lowermost weft layer, and then again appearing between the uppermost weft layer and the intermediate weft layer to complete one cycle of a weave pattern;

whereby when said forming fabric is stretched longitudinally, the under-side knuckles of said lower warp layer are positioned higher than the underside knuckles of adjacent threads of said lowermost weft layer, such that the lowermost weft layer is subject to wear before the lower warp layer.

2. A forming fabric as claimed in claim 1 in which the warp density of said lower warp layer is coarser than that of said upper warp layer.

3. A forming fabric as claimed in claim 2 in which said warp density of said lower warp layer is one half of that of said upper warp layer.

4. A forming fabric as claimed in claim 3 in which the warp threads of said lower warp layer are disposed beneath alternate ones of said upper warp layer.

5. A forming fabric as claimed in any one of claims 1 to 4 in which the diameter of the warp threads of said lower warp layer is greater than that of said upper warp layer.

6. A forming fabric as claimed in claim 5 in which said diameter of the warp threads of said lower warp layer is within the range of 1.3 to 2 times of that of the threads of said upper warp layer.

7. A forming fabric for use in a papermaking machine having two warp layers consisting of machine direction threads and three weft layers consisting of cross machine direction threads, comprising:

an uppermost weft layer adapted to define the paper-web supporting surface of said fabric during use;

an intermediate weft layer arranged below said uppermost weft layer;

a lowermost weft layer arranged below said intermediate weft layer to define the under-side of said fabric during use and having a coarser weft density of said fabric than that of said intermediate weft layer;

an upper warp layer, the warp threads of which are interwoven only with said uppermost weft layer and with said intermediate weft layer; and a lower warp layer, the warp threads of which are interwoven only with said intermediate weft layer and said lowermost weft layer, the warp threads of the lower warp layer passing between the uppermost weft layer and the intermediate weft layer, and then again between the intermediate weft layer and the lowermost weft layer, and then beneath the lowermost weft layer, and then again between the intermediate weft layer and the lowermost weft layer and then again appearing between the uppermost weft layer and the intermediate weft layer to complete one cycle of a weave pattern;

whereby when said forming fabric is stretched longitudinally, the under-side knuckles of said lower warp layer are positioned higher than the under-side knuckles of adjacent threads of said lowermost weft layer, such that the lowermost weft layer is subject to wear before the lower warp layer.

8. A forming fabric as claimed in claim 7 in which said weft density of said lowermost weft layer is one half of that of said intermeditate weft layer.

9. A forming fabric as claimed in claim 8 in which the weft threads of said lowermost weft layer are disposed beneath alternate ones of said intermediate weft layer.

10. A forming fabric as claimed in any one of claims 7, 8 and 9 in which the diameter of the weft threads of said lowermost weft layer is greater than that of the threads of said intermediate weft layer.

11. A forming fabric as claimed in claim 10 in which said diameter of the weft threads of said lowermost weft layer is within the range of 1.3 to 2 times of that of the threads of said intermediate weft layer.

12. A forming fabric as claimed in any one of claims 7 to 11 in which the warp density of said lower warp layer is coarser than that of said upper warp layer.

13. A forming fabric as claimed in claim 12 in which said warp density of said lower warp layer is one half of that of said upper warp layer.

14. A forming fabric as claimed in claim 13 in which the warp threads of said lower warp layer is disposed beneath alternate ones of said upper warp layer.

15. A forming fabric as claimed in any one of claims 7 to 14 in which the diameter of the warp threads of said lower warp layer is greater than that of the threads of said upper warp layer.

16. A forming fabric as claimed in claim 15 in which said diameter of the warp threads of said lower warp layer is within the range of 1.3 to 2 times of that of the threads of said upper warp layer.

17. In a method for making paper wherein a paper-web is formed on a forming fabric in the wire part of a papermaking machine, the improvement comprising using a forming fabric having two warp layers consisting of machine direction threads and three weft layers consisting of cross machine direction threads, comprising:

an uppermost weft layer adapted to define the paper-web supporting surface of said fabric during use;

an intermediate weft layer arranged below said uppermost weft layer;

a lowermost weft layer arranged below said intermediate weft layer to define the under-side of said fabric during use;

an upper warp layer, the warp threads of which are interwoven only with said uppermost weft layer and with said intermediate weft layer; and a lower warp layer, the warp threads of which are interwoven only with said intermediate weft layer and said lowermost weft layer, the warp threads of the lower warp layer passing between the uppermost weft layer and the intermediate weft layer, and then between the intermediate weft layer and the lowermost weft layer, and then beneath the lowermost weft layer, and then again between the intermediate weft layer and the lowermost weft layer, and then again appearing between the uppermost weft layer and the intermediate weft layer to complete one cycle of a weave pattern;

whereby when said forming fabric is stretched longitudinally, the under-side knuckles of said lower warp layer are positioned higher than the under-side knuckles of adjacent threads of said lowermost weft layer, such that the lowermost weft layer is subject to wear before the lower warp layer.

* * * * *